US008986421B2

(12) United States Patent
Sipilä et al.

(10) Patent No.: US 8,986,421 B2
(45) Date of Patent: Mar. 24, 2015

(54) METHOD OF CONTROLLING THE THERMAL BALANCE OF THE REACTION SHAFT OF A SUSPENSION SMELTING FURNACE AND A CONCENTRATE BURNER

(75) Inventors: Jussi Sipilä, Espoo (FI); Markku Lahtinen, Espoo (FI); Peter Björklund, Espoo (FI); Kaarle Peltoniemi, Espoo (FI); Tapio Ahokainen, Helsinki (FI); Lauri P. Pesonen, Helsinki (FI)

(73) Assignee: Outotec Oyj, Espoo (FI)

( * ) Notice: Subject to any disclaimer, the term of this patent is extended or adjusted under 35 U.S.C. 154(b) by 197 days.

(21) Appl. No.: 13/502,524

(22) PCT Filed: Oct. 19, 2010

(86) PCT No.: PCT/FI2010/050812

§ 371 (c)(1), (2), (4) Date: Apr. 17, 2012

(87) PCT Pub. No.: WO2011/048265

PCT Pub. Date: Apr. 28, 2011

(65) Prior Publication Data

US 2012/0204679 A1 Aug. 16, 2012

(30) Foreign Application Priority Data

Oct. 19, 2009 (FI) ..... 20096071
Dec. 11, 2009 (FI) ..... 20096311

(51) Int. Cl.
*C22B 1/00* (2006.01)
*F27D 3/00* (2006.01)
(Continued)

(52) U.S. Cl.
CPC ... *F27D 3/16* (2013.01); *C22B 5/12* (2013.01); *C22B 15/00* (2013.01); *F27D 3/18* (2013.01)
USPC ..... 75/330; 75/380; 266/44

(58) Field of Classification Search
CPC ..... C22B 15/00; C22B 5/12; F27D 3/16
USPC ..... 75/380, 330; 266/44
See application file for complete search history.

(56) References Cited

U.S. PATENT DOCUMENTS 4,113,470 A 9/1978 Aaltonen
4,422,624 A * 12/1983 Dunham et al. ..... 266/182
(Continued)

FOREIGN PATENT DOCUMENTS

DE 3627307 A * 2/1988
EP 0499956 A1 8/1992
(Continued)

OTHER PUBLICATIONS

Supply system for suspension smelting furnace (0909). Retrieved from http://search.proquest.com/professional/docview/975033898?accountid=161361 on Apr. 9, 2014.*
(Continued)

*Primary Examiner* — George Wyszomierski
*Assistant Examiner* — Tima M McGuthry Banks
(74) *Attorney, Agent, or Firm* — Chernoff Vilhauer McClung & Stenzel, LLP

(57) ABSTRACT

The invention relates to a method of controlling the thermal balance of the reaction shaft of a suspension smelting furnace and to a concentrate burner for feeding reaction gas and pulverous solid mater into the reaction shaft of the suspension smelting furnace. In the method, endothermic material (16) is fed by the concentrate burner (4) to constitute part of the mixture formed from the powdery solid matter (6) and reaction gas (5), so that a mixture containing the powdery solid matter (6), reaction gas (5) and endothermic material (6) is formed in the reaction shaft (2). The concentrate burner (4) comprises cooling agent feeding equipment (15) for adding the endothermic material (16) to constitute part of the mixture, which is formed from the pulverous solid matter (6) that discharges from the orifice (8) of the feeder pipe and the reaction gas (5) that discharges through the annular discharge orifice (14).

17 Claims, 6 Drawing Sheets

(51) Int. Cl.

| | |
|---|---|
| ***F27D 3/16*** | (2006.01) |
| ***C22B 5/12*** | (2006.01) |
| ***C22B 15/00*** | (2006.01) |
| ***F27D 3/18*** | (2006.01) |

(56) References Cited

U.S. PATENT DOCUMENTS

| | | | | |
|---|---|---|---|---|
| 4,490,170 | A * | 12/1984 | Lilja et al. | 75/455 |
| 4,615,729 | A | 10/1986 | Victorovich et al. | |
| 4,802,917 | A | 2/1989 | Victorovich et al. | |
| 4,824,362 | A * | 4/1989 | Kimura et al. | 432/13 |
| 5,181,955 | A | 1/1993 | Asteljoki | |
| 6,238,457 | B1 | 5/2001 | Holmi | |
| 2009/0226284 | A1 * | 9/2009 | Kojo | 414/161 |

FOREIGN PATENT DOCUMENTS

| | | | |
|---|---|---|---|
| FI | 100889 | B | 3/1998 |
| JP | 1268809 | A | 10/1989 |
| JP | 2002060858 | A | 2/2002 |
| JP | 2003129146 | A | 5/2003 |
| JP | 2003160822 | A | 6/2003 |

OTHER PUBLICATIONS

Machine translation for DE 3627307 A published Feb. 25, 1988.*

Marko Keranen, International Search Report for PCT/FI2010/050812, Feb. 14, 2011.

IPO of the Philippines Subsequent Substantive Examination Report for Philippine Patent Application 1/2012/500558, mailed May 23, 2014, 1 page.

Office Action from corresponding Japanese patent application No. 2012-534733, mailed Dec. 2, 2014, with English translation, 10 pgs.

* cited by examiner

METHOD OF CONTROLLING THE THERMAL BALANCE OF THE REACTION SHAFT OF A SUSPENSION SMELTING FURNACE AND A CONCENTRATE BURNER

This is a national stage application filed under 35 USC 371 based on International Application No. PCT/FI2010/050812 filed Oct. 19, 2010 and claims priority under 35 USC 119 of Finnish Patent Application No. 20096071 filed Oct. 19, 2009 and of Finnish Patent Application No. 20096311 filed Dec. 11, 2009.

BACKGROUND OF THE INVENTION

The object of the invention is a method of controlling the thermal balance of the reaction shaft of a suspension smelting furnace.

Another object of the invention is a concentrate burner for feeding a reaction gas and pulverous solid matter into the reaction shaft of the 10 suspension smelting furnace.

The invention relates to the method that takes place in the suspension smelting furnace, such as a flash smelting furnace, and to the concentrate burner for feeding the reaction gas and pulverous solid matter into the reaction shaft of the suspension smelting furnace, such as flash the smelting furnace.

The flash smelting furnace comprises three main parts: a reaction shaft, a lower furnace and an uptake. In the flash smelting process, the pulverous solid matter that comprises a sulphidic concentrate, slag forming agent and other pulverous components, is mixed with the reaction gas by means of the concentrate burner in the upper part of the reaction shaft. The reaction gas can be air, oxygen or oxygen-enriched air. The concentrate burner comprises normally a feeder pipe for feeding the pulverous solid matter into the reaction shaft, where the orifice of the feeder pipe opens to the reaction shaft. The concentrate burner further comprises normally a dispersing device, which is arranged concentrically inside the feeder pipe and which extends to a distance from the orifices of the feeder pipe inside the reaction shaft and which comprises dispersion gas openings for directing a dispersion gas to the pulverous solid matter that flows around the dispersing device. The concentrate burner further comprises normally a gas supply device for feeding the reaction gas into the reaction shaft, the gas supply device opening to the reaction shaft through an annular discharge orifice that surrounds the feeder pipe concentrically for mixing the said reaction gas that discharges from the annular discharge orifice with the pulverous solid matter, which discharges from the middle of the feeder pipe and which is directed to the side by means of the dispersion gas. The flash smelting process comprises a stage, wherein the pulverous solid matter is fed into the reaction shaft through the orifice of the feeder pipe of the concentrate burner. The flash smelting process further comprises a stage, wherein the dispersion gas is fed into the reaction shaft through the dispersion gas orifices of the dispersing device of the concentrate burner for directing the dispersion gas to the pulverous solid matter that flows around the dispersing device, and a stage, wherein the reaction gas is fed into the reaction shaft through the annular discharge orifice of the gas supply device of the concentrate burner for mixing the reaction gas with the solid matter, which discharges from the middle of the feeder pipe and which is directed to the side by means of the dispersion gas.

In most cases, the energy needed for the melting is obtained from the mixture itself, when the components of the mixture that is fed into the reaction shaft, the powdery solid matter and the reaction gas react with each other. However, there are raw materials, which do not produce enough energy when reacting together and which, for a sufficient melting, require that fuel gas is also fed into the reaction shaft to produce energy for the melting.

At present, there are various known alternatives of correcting upwards the thermal balance of the reaction shaft of the suspension smelting furnace, i.e., raising the temperature of the reaction shaft of the suspension smelting furnace to prevent the reaction shaft of the suspension smelting furnace from cooling. There are not many known ways of correcting downwards the thermal balance of the reaction shaft of the suspension smelting furnace, i.e., lowering the temperature of the reaction shaft of the suspension smelting furnace. One known method is to decrease the feed, i.e., to feed a lesser amount of concentrate and reaction gas into the reaction shaft, for example. For the sake of productivity, it would also be good to succeed in decreasing the thermal balance without decreasing the feed.

The patent specification WO 2009/030808 presents a concentrate burner.

SHORT DESCRIPTION OF THE INVENTION

The object of the invention is to solve the problems mentioned above.

The object of the invention is achieved by the method disclosed herein for controlling the thermal balance of the reaction shaft of the suspension smelting furnace.

The invention also relates to a concentrate burner for feeding reaction gas and pulverous solid matter into the reaction shaft of the suspension smelting furnace.

The preferred embodiments of the invention are presented in the dependent claims.

The invention relates also to the use of the method and the concentrate burner 35.

In the solution according to the invention, the concentrate burner is used for feeding endothermic material to constitute one part of a suspension that is formed from powdery solid matter and reaction gas, so that a mixture containing powdery solid matter, reaction gas and endothermic material is formed in the reaction shaft of the suspension smelting furnace.

The solution according to the invention enables a reduction in the temperature of the reaction shaft without decreasing the feed. This is due to the fact that endothermic material, which is admixed as a component with the mixture that is formed from reaction gas and powdery solid matter consumes energy in the reaction shaft. An endothermic material in the form of a liquid coolant can for example consume energy by evaporating in the reaction shaft and the evaporation energy is taken from the substances in the reaction shaft. The endothermic material can possibly also contain components, which in the conditions of the reaction shaft can disintegrate into smaller partial components, consuming energy according to endothermic reactions. Therefore, the temperature in the reaction shaft can be decreased in a controlled manner.

The solution according to the invention enables an increase in the smelting capacity, i.e., increase in the feed. This is because the increase in temperature due to increasing the feed can be corrected by increasing the feed of the endothermic material, respectively.

LIST OF FIGURES

In the following, some preferred embodiments of the invention are described in detail with reference to the appended figures, wherein.

DETAILED DESCRIPTION OF THE INVENTION

Figure 1:
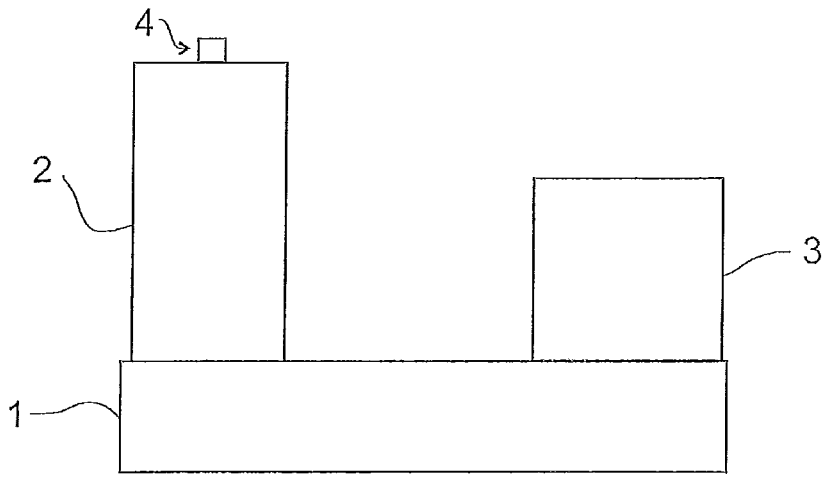
FIG1 PRIOR ART
FIG. 1 is a basic figure of the suspension smelting furnace, in the reaction shaft of which the concentrate burner is arranged.

FIG. 1 shows the suspension smelting furnace comprising a lower furnace 1, reaction shaft 2 and uptake 3. The concentrate burner 4 is arranged in the reaction shaft 2. The operating principle of such a smelting furnace known as such is disclosed in the patent specification U.S. Pat. No. 2,506,557, for example.

The invention firstly relates to a concentrate burner 4 for feeding the reaction gas 5 and pulverous solid matter 6 into the reaction shaft 2 of the suspension smelting furnace. The reaction gas 5 can be, for example, oxygen-enriched air or it can contain oxygen-enriched air. The pulverous solid matter can be, for example, copper or nickel concentrate.

The concentrate burner 4 comprises a solid matter supply device 23 for feeding pulverous solid matter 6 into the reaction shaft 2 and a gas supply device 12 for feeding reaction gas 5 into the reaction shaft 2.

The concentrate burner 4 comprises cooling agent feeding equipment 15 for adding endothermic material 16 to constitute part of the mixture, which is formed in the reaction shaft 2 of the suspension smelting furnace 1 from pulverous solid matter 6 and reaction gas 5.

The cooling agent feeding equipment 15 may be configured for feeding endothermic material 16 into the pulverous solid matter supply device 23 for feeding endothermic material 16 by means of the pulverous solid matter supply device 23 of the concentrate burner 4.

The cooling agent feeding equipment 15 may be configured for feeding endothermic material 16 into the gas supply device 12 for feeding endothermic material 16 by means of the gas supply device 12 of the concentrate burner 4.

The concentrate burner 4 may comprise a dispersing device 9 for directing dispersion gas 11 to pulverous solid matter 6 in the reaction shaft 1 for directing pulverous solid matter 6 to reaction gas 5 in the reaction shaft 1. In this case, the cooling agent feeding equipment 15 may be configured for feeding endothermic material 16 into the dispersing device 9 for feeding endothermic material 16 by means of the dispersing device 9 of the concentrate burner 4.

The concentrate burner 4 shown in FIGS. 2-6 comprises a feeder pipe 7 for feeding pulverous solid matter into the reaction shaft 2, the orifice 8 of the feeder pipe opening to the reaction shaft 2.

The concentrate burner 4 shown in FIGS. 2-6 further comprises a dispersing device 9, which is arranged concentrically inside the feeder pipe 7 and which extends to a distance from the orifice 8 of the feeder pipe inside the reaction shaft 2. The dispersing device 9 comprises dispersion gas openings 10 for directing dispersion gas 11 around the dispersing device 9 and to pulverous solid matter that flows around the dispersing device 9.

The concentrate burner 4 shown in FIGS. 2-6 further comprises a gas supply device 12 for feeding reaction gas 5 into the reaction shaft 2. The gas supply device 12 comprises a reaction gas chamber 13, which is arranged outside the reaction shaft 2 and which opens to the reaction shaft 2 through the annular discharge orifice 14 that surrounds the feeder pipe 7 concentrically for mixing reaction gas 5 discharging from the discharge orifice with pulverous solid matter 6, which discharges from the middle of the feeder pipe 7 and which is directed to the side by means of dispersion gas 11.

The concentrate burner 4 shown in FIGS. 2-6 further comprises cooling agent feeding equipment 15 for adding a endothermic material 16 to constitute part of the mixture 20, which is formed in the reaction shaft 2 of the suspension smelting furnace 1 from pulverous solid matter 6 that discharges from the orifice 8 of the feeder pipe and reaction gas 5 that discharges through the annular discharge orifice 14.

Figure 2:
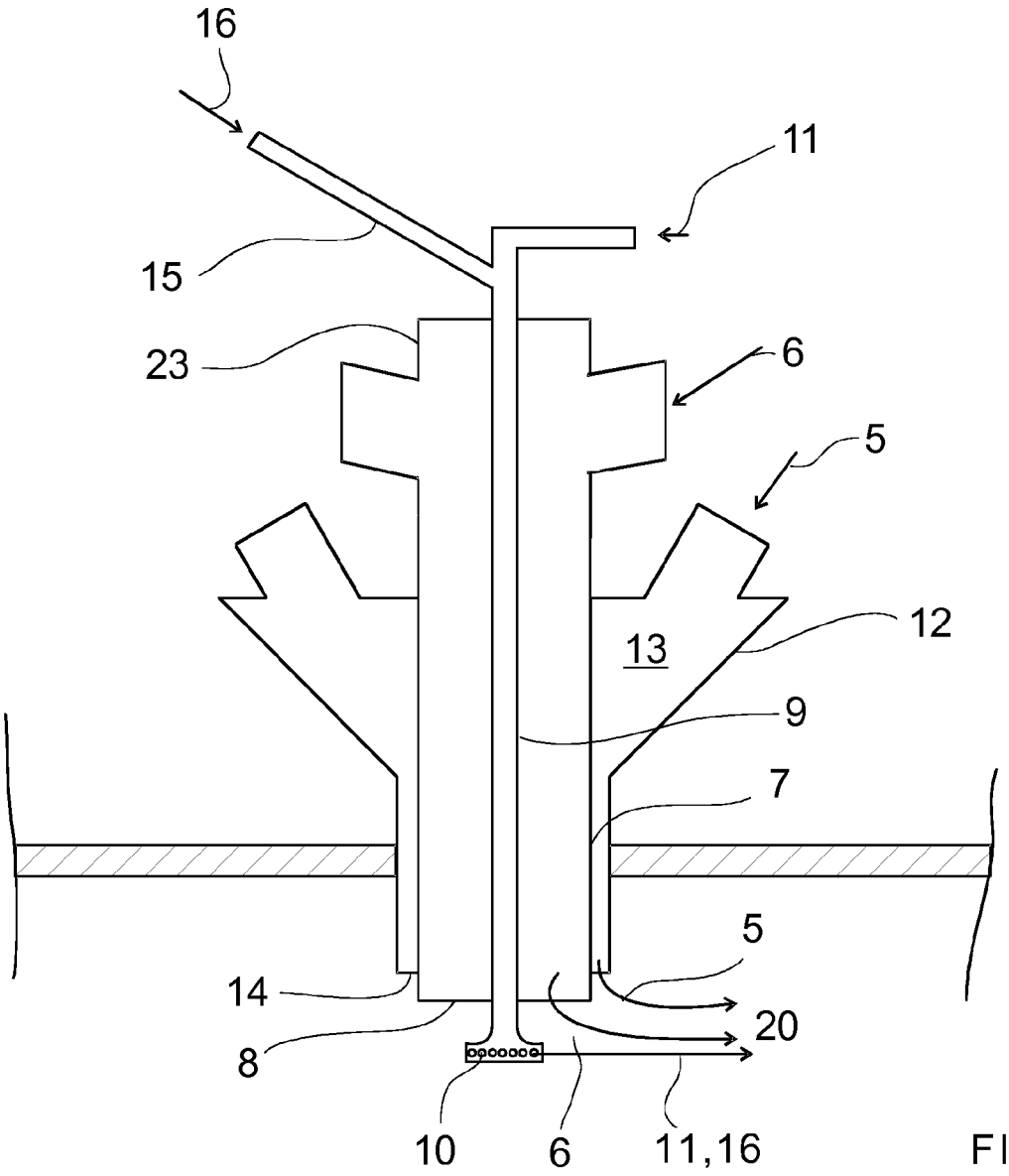
FIG. 2 shows a first preferred embodiment of the concentrate burner according to the invention.

FIG. 2 shows a first preferred embodiment of the concentrate burner 4 according to the invention. The cooling agent feeding equipment 15 in FIG. 2 is arranged so as to feed endothermic material 16 into the dispersing device 9, so that dispersion gas 11 that is fed from the dispersion gas orifices 10 at least partly consists of endothermic material 16.

Figure 3:
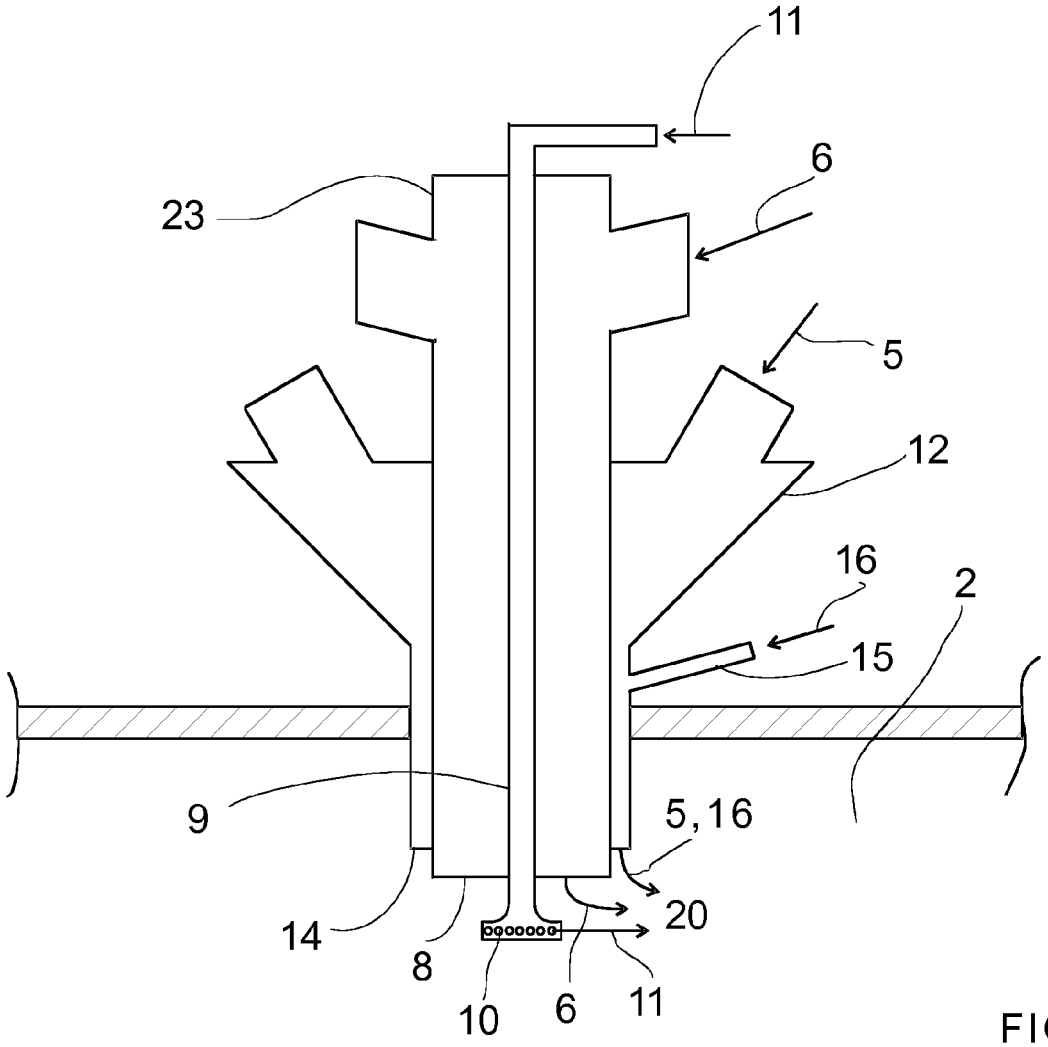
FIG. 3 shows a second preferred embodiment of the concentrate burner according to the invention.

FIG. 3 shows a second preferred embodiment of the concentrate burner 4 according to the invention. In FIG. 2, the cooling agent feeding equipment 15 is arranged so as to feed endothermic material 16 into the gas supply device 12, so that reaction gas 5 that discharges from the discharge orifice through the annular discharge orifice 14, which concentrically surrounds the feeder pipe 7, contains endothermic material 16.

Figure 4:
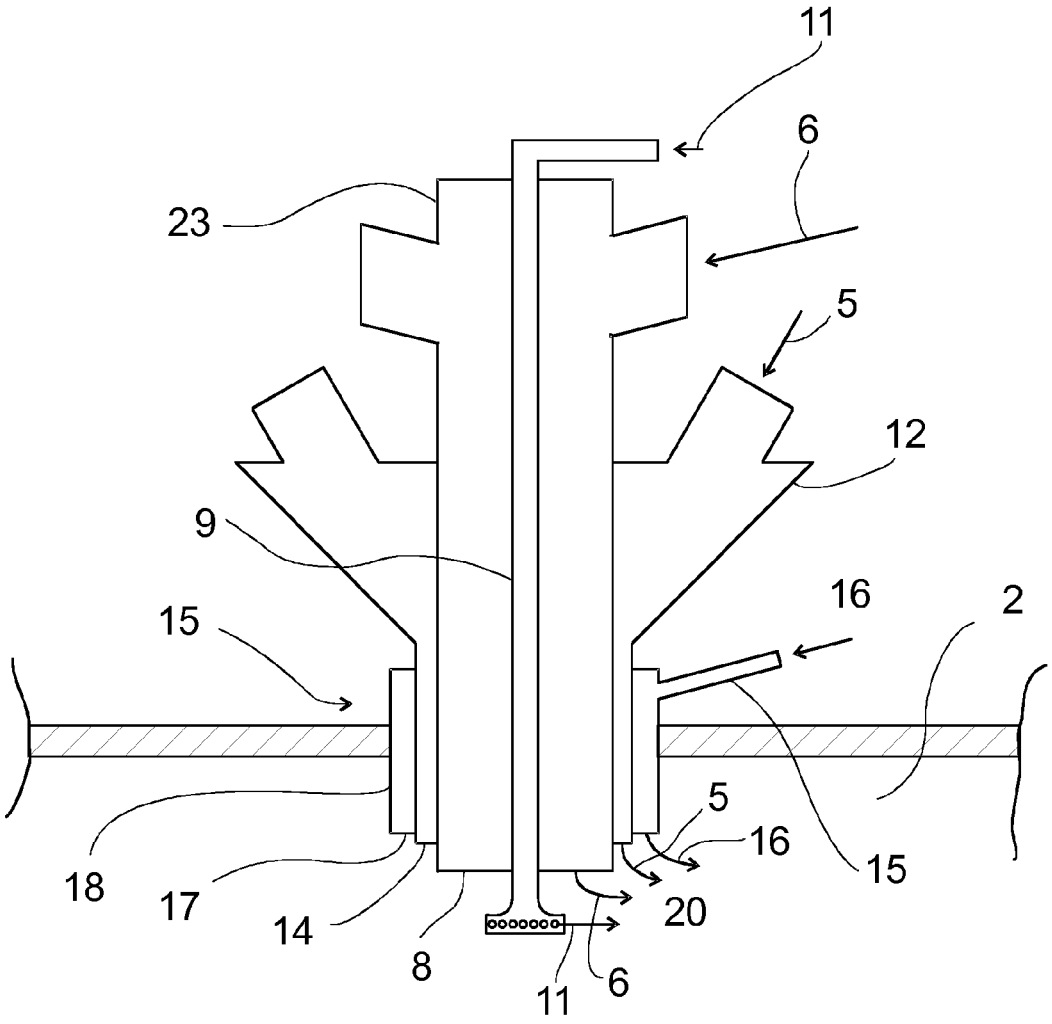
FIG. 4 shows a third preferred embodiment of the concentrate burner according to the invention.

FIG. 4 shows a third preferred embodiment of the concentrate burner 4 according to the invention. In FIG. 4, the cooling agent feeding equipment 15 comprises a cooling agent supply device 18 of the gas supply device 12, comprising a second annular discharge orifice 17 and being arranged outside the reaction gas chamber 13, for feeding endothermic material 16 through the said second annular discharge orifice for mixing endothermic material 16 with the mixture of powdery solid matter 6 and reaction gas 5.

Figure 5:
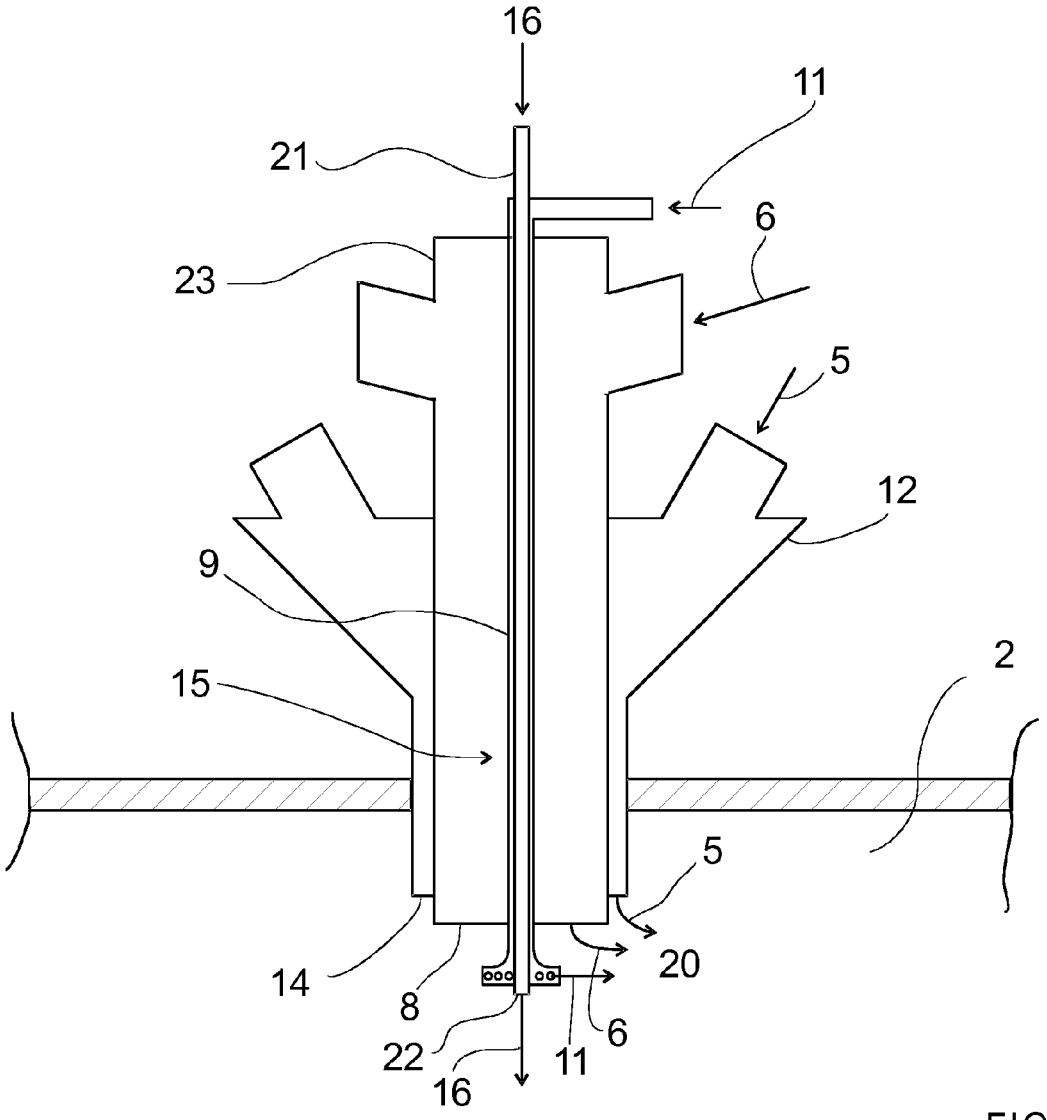
FIG. 5 shows a fourth preferred embodiment of the concentrate burner according to the invention.

FIG. 5 shows a fourth preferred embodiment of the concentrate burner 4 according to the invention. In FIG. 5, the concentrate burner 4 comprises a central lance 21 inside the dispersing device 9, the lance comprising a discharge orifice 22 that opens to the reaction shaft 2 of the suspension smelting furnace. In the fourth embodiment according to FIG. 5, the cooling agent feeding equipment 15 is arranged so as to feed endothermic material 16 into the central lance 21, so that endothermic material 16 can be fed into the reaction shaft 2 of the suspension smelting furnace through the discharge orifice 22 of the central lance 21.

Figure 6:
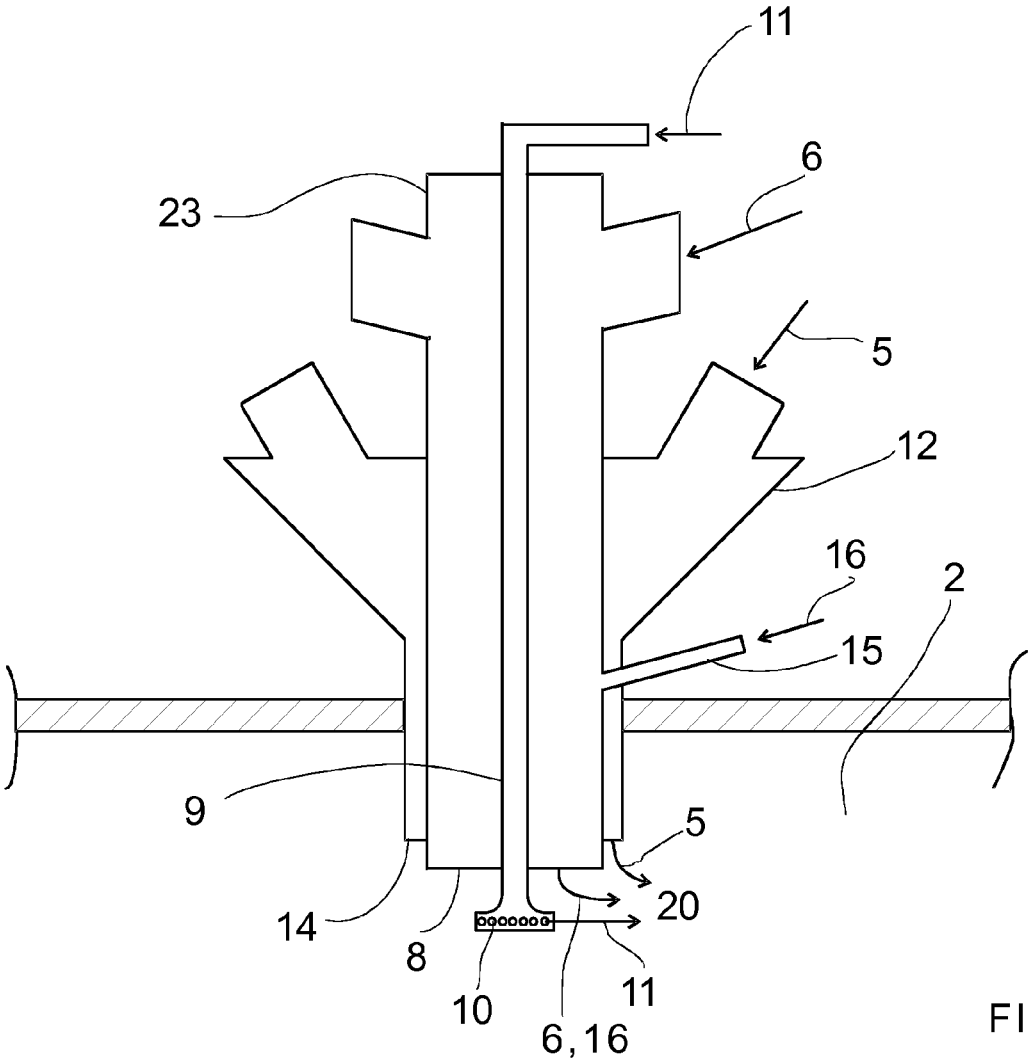
FIG. 6 shows a fifth preferred embodiment of the concentrate burner according to the invention.

FIG. 6 shows a fifth preferred embodiment of the concentrate burner 4 according to the invention. In FIG. 6 the cooling agent feeding equipment 15 are configured for feeding endothermic material 16 into the pulverous solid matter supply device 23 such that from the orifice 8 of the feeder pipe mixture of pulverous solid matter 6 and endothermic material 16 discharged into the reaction shaft 2.

The endothermic material 16 can be, e.g., a liquid, solution or suspension. The endothermic material 16 can be a liquid cooling agent, which when evaporating consumes energy, i.e. decomposes endothermically. In other words, the endothermic material 16 is preferably one, which does not produce thermal energy in the reaction shaft 2 of the suspension smelting furnace 2, but which consumes thermal energy in the reaction shaft 2 of the suspension smelting furnace.

The cooling agent feeding equipment 15 may be arranged so as to feed endothermic material 16 as a spray into the reaction shaft 2 of the suspension smelting furnace.

The endothermic material 16 comprises preferably, but not necessarily, at least one of the following: Water, acid, such as sulphuric acid, metallic salt and metallic sulphate, such as copper sulphate or nickel sulphate.

Another object of the invention is a method of controlling the thermal balance of the reaction shaft 2 of the suspension smelting furnace.

In the method a concentrate burner 4 is used that comprises a pulverous solid matter supply device 23 for feeding pulverous solid matter 6 into the reaction shaft 2 and a gas supply device 12 for feeding reaction gas 5 into the reaction shaft 2.

The method comprising feeding into the reaction shaft 2 pulverous solid matter 6 and feeding reaction gas 5 into the reaction shaft 2 for mixing reaction gas 5 with pulverous solid matter 6.

In the method endothermic material 16 is fed by the concentrate burner 4 to constitute part of the mixture formed by powdery solid matter 6 and reaction gas 5 in the reaction shaft 2 of the suspension smelting furnace 1, so that a mixture containing powdery solid matter 6, reaction gas 5 and endothermic material 16 is formed in the reaction shaft 1 of the suspension smelting furnace 1.

In the method may endothermic material 16 and pulverous solid matter 6 be mixed outside the reaction shaft 1 and mixture of endothermic material 16 and pulverous solid matter 6 may be fed into the reaction shaft 1 by means of the concentrate burner 4.

In the method may in endothermic material 16 be fed into the pulverous solid matter supply device 23 and endothermic material 16 and pulverous solid matter 6 be mixed in the pulverous solid matter supply device 23 outside the reaction shaft 1 so that mixture of endothermic material 16 and pulverous solid matter 6 is fed into the reaction shaft 1 by means of the concentrate burner 4.

In the method may endothermic material 16 and reaction gas 5 be mixed outside the reaction shaft 1 and mixture of endothermic material 16 and reaction gas 5 may be fed into the reaction shaft 1 by means of the concentrate burner 4.

In the method may endothermic material 16 be fed into the gas supply device 12 and endothermic material 16 and reaction gas 5 may be mixed in the gas supply device 12 outside the reaction shaft 1 so that mixture of endothermic material 16 and reaction gas 5 is fed into the reaction shaft 1 by means of the concentrate burner 4.

In the method may a such concentrate burner 4 be used that comprises a dispersing device 9 for directing dispersion gas 11 to pulverous solid matter 6 in the reaction shaft 1 for directing pulverous solid matter 6 to reaction gas 5 in the reaction shaft 1. In this case may endothermic material 16 and dispersion gas 11 be mixed outside the reaction shaft 1 and mixture of endothermic material 16 and dispersion gas 11 may be fed into the reaction shaft 1 by means of the concentrate burner 4. Alternatively or additionally may endothermic material 16 in this case be fed into the dispersing device 9 and endothermic material 16 and dispersion gas 11 may be mixed in the dispersing device 9 outside the reaction shaft 1 such that in that mixture of endothermic material 16 and dispersion gas 11 is fed into the reaction shaft 1 by means of the concentrate burner 4.

In the method a such concentrate burner 4 be used, which comprises (i) a pulverous solid matter supply device 23 comprising feeder pipe 7 for feeding pulverous solid matter 6 into the reaction shaft 2, where the orifice 8 of the feeder pipe opens to the reaction shaft 2; (ii) a dispersing device 9, which is arranged concentrically inside the feeder pipe 7 and which extends to a distance from the orifice 8 of the feeder pipe inside the reaction shaft 2 and which comprises dispersion gas openings 10 for directing dispersion gas 11 around the dispersing device 9 and to pulverous solid matter 6 that flows around the dispersing device 9; and a (iii). a gas supply device 12 for feeding reaction gas 5 into the reaction shaft 2, the gas supply device 12 opening to the reaction shaft 2 through the annular discharge orifice 14 that surrounds the feeder pipe 7 concentrically for mixing said reaction gas 5 that discharges from the annular discharge orifice 14 with pulverous solid matter 6, which discharges from the middle of the feeder pipe 7 and which is directed to the side by means of the dispersion gas 11. An example of such concentrate burner 4 is shown in FIGS. 2-6.

If in the method a concentrate burner 4 of the type as shown in FIGS. 2-6 is used, pulverous solid matter 6 is fed into the reaction shaft 2 through the orifice 8 of the feeder pipe of the concentrate burner 4.

If in the method a concentrate burner 4 of the type as shown in FIGS. 2-6 is used, dispersion gas 11 is fed into the reaction shaft 2 through the dispersion gas orifices 10 of the dispersing device 9 of the concentrate burner 4 for directing dispersion gas 11 to pulverous solid matter 6 that flows around the dispersing device 9.

If in the method a concentrate burner 4 of the type as shown in FIGS. 2-6 is used, reaction gas 5 is fed into the reaction shaft 2 through the annular discharge orifice 14 of the gas supply device of the concentrate burner 4 for mixing reaction gas 5 with pulverous solid matter 6, which discharges from the middle of the feeder pipe 7 and which is directed to the side by means of dispersion gas 11.

If in the method a concentrate burner 4 of the type as shown in FIGS. 2-6 is used, the concentrate burner 4 is used for feeding endothermic material 16 to constitute one component of the mixture that is formed from powdery solid matter 6 and reaction gas 5 in the reaction shaft 2 of the suspension smelting furnace 1, so that a mixture is formed in the reaction shaft 2 of the suspension smelting furnace 1, containing powdery solid matter 6, reaction gas 5 and endothermic material 16.

In a first preferred embodiment of the method according to the invention, endothermic material 16 is fed through the dispersion gas orifices 10 of the dispersing device 9 of the concentrate burner 4, so that dispersion gas 11 that is to be fed at least partly consists of endothermic material 16. FIG. 2 shows the concentrate burner 4, which applies this first preferred embodiment of the method according to the invention.

In a second preferred embodiment of the method according to the invention, endothermic material 16 is fed into the gas supply device 12 of the concentrate burner 4, so that reaction gas 5 that discharges through the annular discharge orifice 14 of the gas supply device, which surrounds the feeder pipe 7 concentrically, contains endothermic material 16. FIG. 3 shows a concentrate burner 4, which applies this second preferred embodiment of the method according to the invention.

In a third preferred embodiment of the method according to the invention, cooling agent feeding equipment 15 is arranged outside the gas supply device 12, comprising a cooling agent supply device 18, which comprises a second annular discharge orifice 17, which is concentric with the annular discharge orifice 14 of the gas supply device and which opens to the reaction chamber. In this preferred embodiment, endothermic material 16 is fed through the said second annular discharge orifice for at least partly mixing endothermic material 16 with the mixture of powdery solid matter 6 and reaction gas 5. FIG. 2 shows a concentrate burner 4, which applies this third preferred embodiment of the method according to the invention.

In a fourth preferred embodiment of the method according to the invention, a central lance 21 is arranged inside the dispersing device 9 of the concentrate burner, comprising a discharge orifice 22, which opens to the reaction shaft 2 of the suspension smelting furnace. In this preferred embodiment, endothermic material 16 is fed through the discharge orifice 22 of the central lance 21 into the reaction shaft 2 of the suspension smelting furnace for mixing endothermic material 16 at least partly with the mixture of powdery solid matter 6 and reaction gas 5. In a fourth preferred embodiment of the method according to the invention endothermic material 16 is fed into the pulverous solid matter supply device 23 such that from the orifice 8 of the feeder pipe mixture of pulverous solid matter 6 and endothermic material 16 discharged into the reaction shaft 2.

The endothermic material 16 can be, e.g., a liquid, solution or suspension. The endothermic material 16 can be a liquid cooling agent, which when evaporating consumes energy, i.e. decomposes endothermically. In other words, the endothermic material 16 is preferably one, which does not produce thermal energy in the reaction shaft 2 of the suspension smelting furnace but which consumes thermal energy in the reaction shaft 2 of the suspension smelting furnace.

In the method according to the invention, e.g., endothermic material 16 can be fed as a spray into the reaction shaft 2 of the suspension smelting furnace.

In the method according to the invention, the endothermic material 16 comprises preferably, but not necessarily, at least one of the following: Water, metallic salt, acid, such as sulphuric acid, and metallic sulphate, such as copper sulphate or nickel sulphate.

The method and the concentrate burner according to the invention can be used for controlling thermal balance in a reaction shaft of a suspension smelting furnace It is obvious to those skilled in the art that with the technology improving, the basic idea of the invention can be implemented in various ways. Thus, the invention and its embodiments are not limited to the examples described above but they may vary within the claims.

The invention claimed is:

1. A method of controlling thermal balance of a reaction shaft of a suspension smelting furnace, comprising using a concentrate burner that comprises a pulverous solid matter supply device for feeding pulverous solid matter into the reaction shaft, and a gas supply device for feeding reaction gas into the reaction shaft, the method comprising feeding into the reaction shaft pulverous solid matter, and feeding reaction gas into the reaction shaft for mixing reaction gas with pulverous solid matter to form a mixture by powdery solid matter and reaction gas in the reaction shaft of the suspension smelting furnace, wherein endothermic material is fed by the concentrate burner to constitute part of the mixture formed by powdery solid matter and reaction gas in the reaction shaft of the suspension smelting furnace, so that a mixture containing powdery solid matter, reaction gas and endothermic material is formed in the reaction shaft of the suspension smelting furnace;

and wherein the endothermic material is a liquid cooling agent.

2. A method according to claim 1, wherein endothermic material and pulverous solid matter is mixed outside the reaction shaft, and mixture of endothermic material and pulverous solid matter is fed into the reaction shaft by means of the concentrate burner.

3. A method according to claim 1, wherein endothermic material is fed into the pulverous solid matter supply device and endothermic material and pulverous solid matter is mixed in pulverous solid matter supply device outside the reaction shaft, mixture of endothermic material and pulverous solid matter is fed into the reaction shaft by means of the concentrate burner.

4. A method according to claim 1, wherein endothermic material and reaction gas is mixed outside the reaction shaft, and mixture of endothermic material and reaction gas is fed into the reaction shaft by means of the concentrate burner.

5. A method according to claim 1, wherein endothermic material is fed into the gas supply device and endothermic material and reaction gas is mixed in the gas supply device outside the reaction shaft, and mixture of endothermic material and reaction gas is fed into the reaction shaft by means of the concentrate burner.

6. A method according to claim 1, wherein the concentrate burner is used that comprises a dispersing device for directing dispersion gas to pulverous solid matter in the reaction shaft for directing pulverous solid matter to reaction gas in the reaction shaft.

7. A method according to claim 6, wherein endothermic material and dispersion gas is mixed outside the reaction shaft, and mixture of endothermic material and dispersion gas is fed into the reaction shaft by means of the concentrate burner.

8. A method according to claim 6, wherein endothermic material is fed into the dispersing device and endothermic material and dispersion gas is mixed in the dispersing device outside the reaction shaft, and mixture of endothermic material and dispersion gas is fed into the reaction shaft by means of the concentrate burner.

9. A method according to claim 1, comprising where the concentrate burner that comprises a pulverous solid matter supply device comprising a feeder pipe for feeding pulverous solid matter into the reaction shaft, where the orifice of the feeder pipe opens to the reaction shaft;

a dispersing device, which is arranged concentrically inside the feeder pipe and which extends to a distance from the orifice of the feeder pipe inside the reaction shaft and which comprises dispersion gas openings for directing a dispersion gas around the dispersing device and to pulverous solid matter that flows around the dispersing device; and a gas supply device for feeding reaction gas into the reaction shaft, the gas supply device opening to the reaction shaft through an annular discharge orifice that surrounds the feeder pipe concentrically for mixing reaction gas that discharges from the annular discharge orifice with pulverous solid matter, which discharges from the middle of the feeder pipe and which is directed to the side by means of dispersion gas;

the method comprising feeding into the reaction shaft pulverous solid matter into the reaction shaft through the orifice of the feeder pipe of the concentrate burner;

feeding dispersion gas into the reaction shaft through the dispersion gas orifices of the dispersing device of the concentrate burner for directing dispersion gas to pulverous solid matter that flows around the dispersing device; and feeding reaction gas into the reaction shaft through the annular discharge orifice of the gas supply device of the concentrate burner for mixing reaction gas with pulverous solid matter, which discharges from the middle of the feeder pipe and which is directed to the side by means of dispersion gas.

10. A method according to claim 9, wherein endothermic material is fed through the dispersion gas openings of the dispersing device of the concentrate burner, so that dispersion gas that is to be fed at least partly consists of endothermic material.

11. A method according to claim 9, wherein endothermic material is fed into the gas supply device of the concentrate burner, so that reaction gas, which discharges through the annular discharge orifice of the gas supply device that concentrically surrounds the feeder pipe of the concentrate burner, contains endothermic material.

12. A method according to claim 9, wherein cooling agent feeding equipment is arranged outside the gas supply device of the concentrate burner, comprising a cooling agent supply device, which comprises a second annular discharge orifice, which is concentric with the annular discharge orifice of the gas supply device of the concentrate burner and which opens to the reaction shaft of the suspension smelting furnace; and endothermic material is fed through the said second annular discharge orifice into the reaction shaft of the suspension smelting furnace for mixing endothermic material with mixture of powdery solid matter and reaction gas.

13. A method according to claim 9, wherein a central lance is arranged inside the dispersing device of the concentrate burner, comprising a discharge orifice that opens to the reaction shaft of the suspension smelting furnace; and endothermic material is fed through the discharge orifice of the central lance into the reaction shaft of the suspension smelting furnace for mixing endothermic material with mixture of powdery solid matter and reaction gas.

14. A method according to claim 9, wherein endothermic material is fed into the pulverous solid matter supply device such that from the orifice of the feeder pipe mixture of pulverous solid matter and endothermic material discharged into the reaction shaft.

15. A method according to claim 1, the endothermic material comprises at least one of a group consisting of: water, metallic salt, acid, and metallic sulfate.

16. A method according to claim 15 where the acid is sulfuric acid.

17. A method according to claim 15 where the metallic is copper sulfate or nickel sulfate.

* * * * *